US009711899B2

(12) United States Patent
Hachuda

(10) Patent No.: US 9,711,899 B2
(45) Date of Patent: Jul. 18, 2017

(54) LATCH MECHANISM HAVING LATCH LOCKING PARTS TO PREVENT ROTATION OF LATCH PARTS

(71) Applicant: ENPLAS CORPORATION, Kawaguchi-shi, Saitama (JP)

(72) Inventor: Osamu Hachuda, Kawaguchi (JP)

(73) Assignee: ENPLAS CORPORATION, Kawaguchi (JP)

( * ) Notice: Subject to any disclaimer, the term of this patent is extended or adjusted under 35 U.S.C. 154(b) by 0 days.

(21) Appl. No.: 15/300,620

(22) PCT Filed: Mar. 27, 2015

(86) PCT No.: PCT/JP2015/059575
§ 371 (c)(1),
(2) Date: Sep. 29, 2016

(87) PCT Pub. No.: WO2015/152035
PCT Pub. Date: Oct. 8, 2015

(65) Prior Publication Data

US 2017/0117665 A1 Apr. 27, 2017

(30) Foreign Application Priority Data

Mar. 31, 2014 (JP) ..... 2014-071610

(51) Int. Cl.
*H01R 13/62* (2006.01)
*H01R 13/639* (2006.01)
(Continued)

(52) U.S. Cl.
CPC ..... *H01R 13/639* (2013.01); *H01R 12/7011* (2013.01); *H01R 12/88* (2013.01)

(58) Field of Classification Search
CPC .... H01R 12/88; H01R 13/62; H01R 13/6271; H01R 13/6275; H01R 13/633; H01R 13/635; H01R 13/62933
(Continued)

(56) References Cited

U.S. PATENT DOCUMENTS 6,264,485 B1 * 7/2001 Saka ..... H01R 13/62938 439/157
6,341,972 B1 * 1/2002 Odorfer ..... H01R 13/582 439/352
(Continued)

FOREIGN PATENT DOCUMENTS

JP 3-61587 6/1991
JP 7-25722 6/1995
(Continued)

OTHER PUBLICATIONS

International Search report mailed Jun. 30, 2015, in corresponding International Application No. PCT/JP2015/059575.

*Primary Examiner* — Chandrika Prasad
(74) *Attorney, Agent, or Firm* — Staas & Halsey LLP

(57) ABSTRACT

A latch mechanism for securely locking a latch and a socket for electrical component.

A cover member includes a cover body covering an upper side opening surface of a housing body, an elevating part supported by the cover body such that the elevating part can be moved up and down, and a pressing part supported by the cover body and moving down the elevating member. Top end portions of latch parts are rotatably supported on outside surfaces of the cover body. Bottom end portions of the latch parts are engaged with the housing body, so as to fix the cover body to the housing body. The elevating part is provided with latch locking parts that are engaged with the latch parts when moved down, so as to prevent the latch parts from rotating in a direction in which engagement between the latch parts and the housing body is released.

3 Claims, 11 Drawing Sheets

(51) Int. Cl.
*H01R 12/70* (2011.01)
*H01R 12/88* (2011.01)

(58) Field of Classification Search
USPC ..... 439/331, 152, 153, 157, 352
See application file for complete search history.

(56) References Cited

U.S. PATENT DOCUMENTS

| | | | | |
|---|---|---|---|---|
| 6,354,859 | B1 * | 3/2002 | Barabi | G01R 1/0483 257/E23.078 |
| 7,101,209 | B2 * | 9/2006 | Yates | G01R 1/0466 324/756.02 |
| 7,785,125 | B1 * | 8/2010 | Terhune, IV | H05K 7/1053 439/135 |
| 7,815,456 | B2 * | 10/2010 | Kunioka | H01R 13/2421 439/331 |
| 2005/0221653 | A1 * | 10/2005 | Dillon | H01R 13/62977 439/331 |
| 2010/0159731 | A1 * | 6/2010 | Kunioka | H01R 13/2421 439/331 |

FOREIGN PATENT DOCUMENTS

| | | |
|---|---|---|
| JP | 9-298257 | 11/1997 |
| JP | 11-54670 | 2/1999 |
| JP | 2006-252946 | 9/2006 |
| JP | 2010-170980 | 8/2010 |

* cited by examiner

LATCH MECHANISM HAVING LATCH LOCKING PARTS TO PREVENT ROTATION OF LATCH PARTS

CROSS REFERENCE TO THE RELATED APPLICATION

This application is a U.S. national stage application, which claims the benefit under 35 USC §371 of PCT International Patent Application No. PCT/JP2015/059575 filed Mar. 27, 2015 which claims foreign priority benefit under 35 USC §119 of Japanese patent application No. 2014-071610, filed Mar. 31, 2014, the contents of which are herein incorporated by reference.

TECHNICAL FIELD

The present invention relates to a latch mechanism capable of locking a latch and to a socket for electrical component housing an electrical component such as a semiconductor device (hereinafter referred to as an "IC package").

BACKGROUND ART

Conventionally, as a "socket for electrical component", a socket is known that houses an electrical component such as a semiconductor device (hereinafter referred to as an "IC package"). As this type of socket for electrical component, there is an IC socket in which a socket body and a cover unit are completely separated, as described in, for example, Japanese Patent Laid-Open No. 2006-252946.

In the IC socket of Japanese Patent Laid-Open No. 2006-252946, as shown in FIG. 5 thereof, an IC package is housed in the socket body, and a push-fit cover unit is set to an upper surface thereof.

Further, a claw of a latch provided to this push-fit cover unit is engaged with a cover body part. On this occasion, this latch is biased in the closing direction by a coil spring, such that this push-fit cover unit is held by the socket body.

Then, a push-fit member provided to this push-fit cover unit is made to abut against the upper surface of the IC package, and an adjusting knob provided in a middle portion of this push-fit cover unit is rotated in a horizontal direction so as to press this push-fit member, thereby fixing this IC package.

In this manner, it is possible to fix this IC package with an appropriate pressing force.

SUMMARY OF INVENTION

Technical Problem

However, in such a conventional socket, a latch was biased in the closing direction by a coil spring, such that this push-fit cover unit is held by the socket body. Accordingly, there was a possibility that the latch is unlocked due to the oscillation of the IC socket etc.

Accordingly, an object of the present invention is to provide a latch mechanism capable of securely locking a latch and a socket for electrical component using this latch mechanism.

Solution to Problem

In order to achieve the object, the invention according to claim 1 provides a latch mechanism including: a cover member including a cover body covering an upper side opening surface of a housing body, an elevating member supported by the cover body such that the elevating part can be moved up and down, and a pressing part supported by the cover body and moving down the elevating member; a pair of latch parts whose top end portions are rotatably supported on outside surfaces of the cover body, and whose bottom end portions are engaged with the housing body, so as to fix the cover body to the housing body; and latch locking parts provided to the elevating part, and engaged with the latch parts when moved down, so as to prevent rotation of the latch parts in a direction in which engagement between the latch parts and the housing body is released.

In the invention according to claim 2, in addition to the configuration of claim 1, the top end portions of the latch parts are provided with shaft holes for inserting therein rotation shafts provided to the cover body, the bottom end portions of the latch parts are provided with locking claws to be locked to the housing body, the latch locking parts of the elevating part project in a horizontal direction, and locked portions, which are locked by the latch locking parts when the elevating part is moved down, are provided in the vicinity of the shaft holes of the latch parts.

The invention according to claim 3 provides a socket for electrical component, including: a socket body as the housing body in which an electrical component is housed in a housing portion provided in an upper surface side, and a contact pin to be electrically connected to the electrical component is provided; and the cover member removably provided to the socket body and covering the housing portion of the socket body, the socket for electrical component including: the latch mechanism according to claim 1 or 2.

Advantageous Effects of Invention

According to the invention of claim 1, the latch locking parts are provided to the elevating part, and are engaged with the latch parts when the elevating part is moved down, so as to prevent the rotation of the latch parts. Thus, it is possible to securely lock the latch parts only with a simple operation.

According to the invention of claim 2, the latch locking parts of the elevating part project in a horizontal direction, and locked portions to be locked by the latch locking parts are provided in the vicinity of the shaft holes of the latch parts. Thus, it is possible to securely lock the latch parts with a simple operation.

According to the invention of claim 3, because the latch mechanism of the above-described claim 1 or 2 is used, it is possible to provide a socket for electrical component capable of securely locking the latches.

DESCRIPTION OF EMBODIMENTS

[Embodiment 1 of the Present Invention]

Hereinbelow, a description is given of an embodiment 1 of the present invention with reference to FIGS. 1 to 7.

Figure 1:
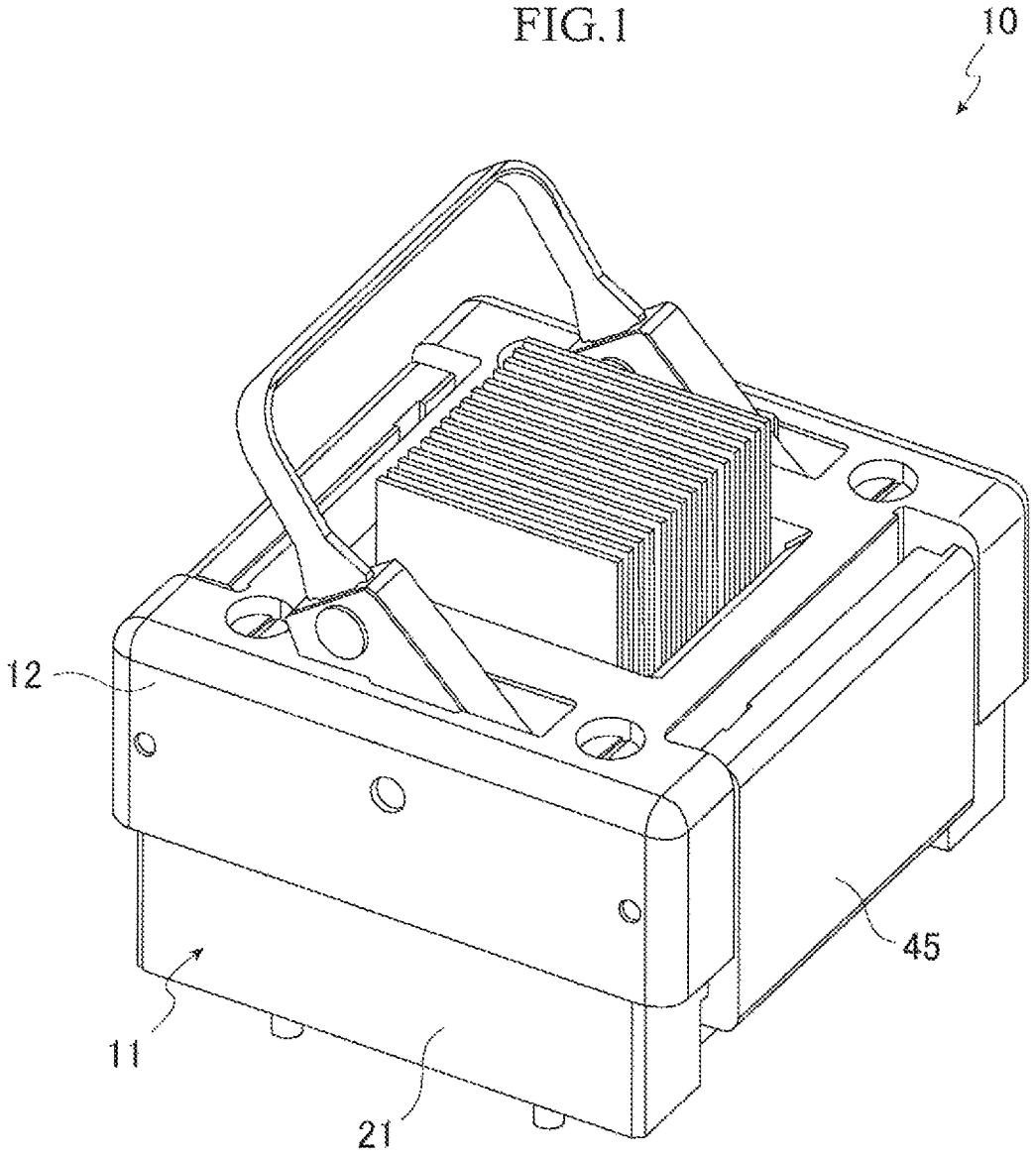
FIG. 1 is a perspective view showing the general configuration of a socket for electrical component in accordance with an embodiment 1 of the present invention.

As shown in FIG. 1 etc., an IC socket 10 as a "socket for electrical component" includes a socket body 11 as a "housing body" and a cover member 12.

Figure 2:
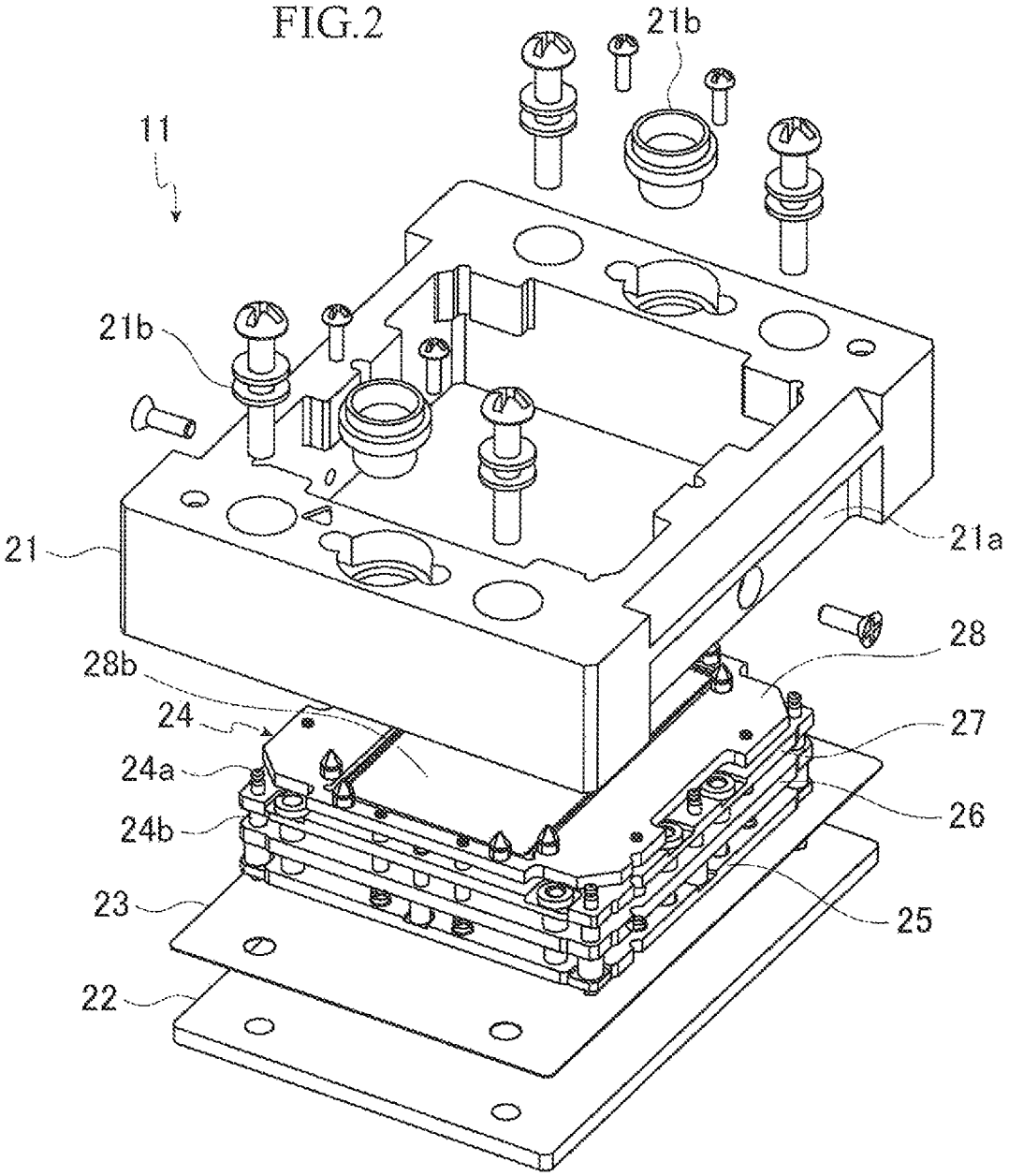
FIG. 2 is an exploded perspective view showing the configuration of a socket body of the socket for electrical component in accordance with the embodiment 1.

The socket body 11 includes, as shown in FIG. 2, a frame-shaped base part 21, a bottom plate 22 covering a bottom surface of this base part 21, an insulating plate 23 provided on an upper surface of this bottom plate 22, and a contact module 24 provided on this insulating plate 23 and housed in the base part 21.

On both left and right side surfaces of the base part 21, a pair of engaging concave portions 21*a* are formed to be engaged with engaging claws 45*d*, which are provided in bottom end portions of latches 45 described later, for fixing the socket body 11 and the cover member 12. In addition, in the vicinity of both front and back side surfaces of the base part 21, bushings 21*b* are provided for positioning the cover member 12 at the time of installation.

Figure 3:
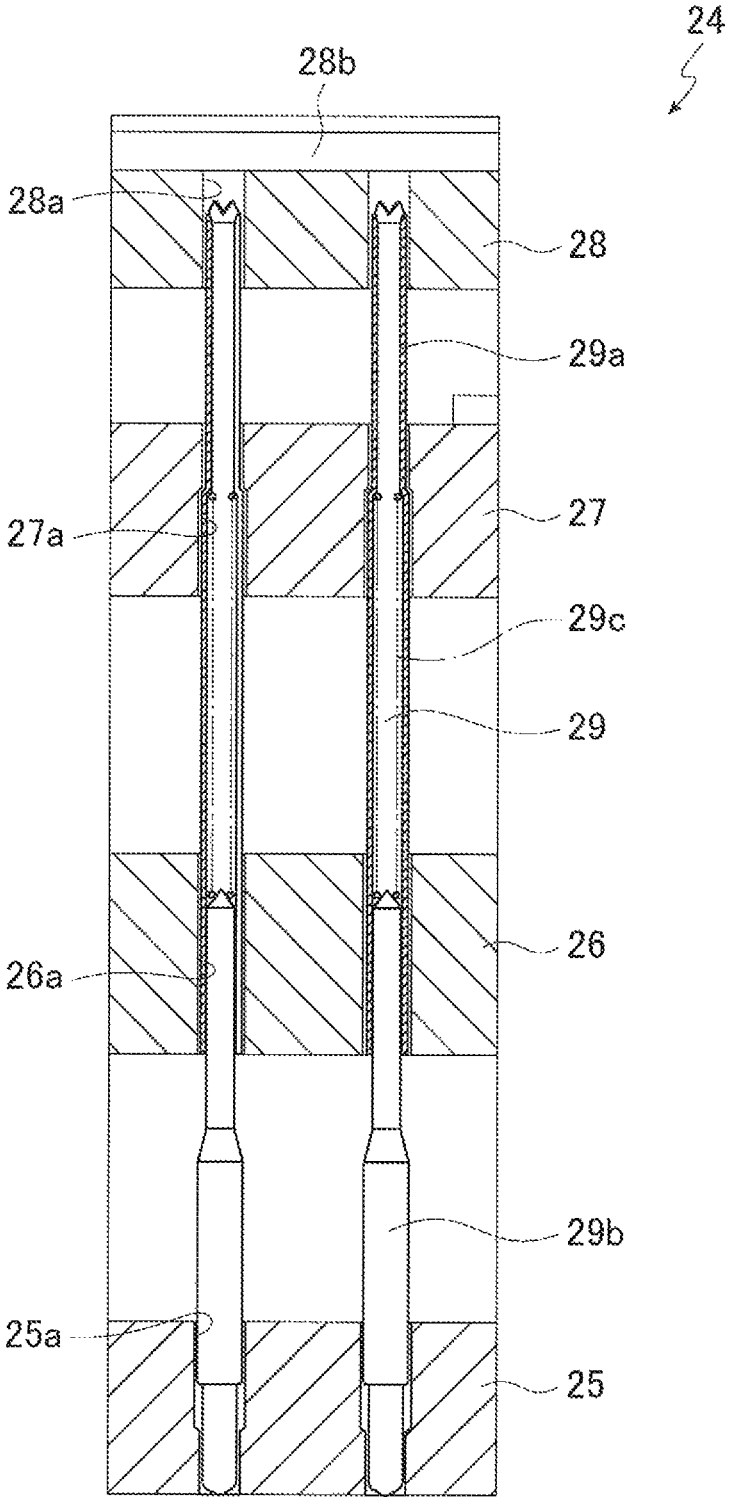
FIG. 3 is a cross-sectional view showing the configuration of a contact module of the socket for electrical component in accordance with the embodiment 1.

Additionally, in the contact module 24, as shown in FIGS. 2 and 3, a first plate 25, a second plate 26, a third plate 27 and a fourth plate (floating plate) 28 are arranged in this order from the bottom, and are fixed apart from each other by using screws 24*a* and spacers 24*b*.

Then, in each of these plates 25 to 28, respective through-holes 25*a* to 28*a* for housing contact pins 29 are formed.

In addition, a housing portion 28*b* for housing an IC package 13 (see FIG. 7 described later) as an "electrical component" is provided in an upper surface of the topmost fourth plate 28. When the IC package 13 is housed in the housing portion 28*b*, each electrode terminal provided on a bottom surface of the IC package 13 is inserted into the through-hole 28*a*, and contacts the contact pin 29.

The contact pin 29 includes, as shown in FIG. 3, a conductive stepped cylindrical upper plunger 29*a*, a conductive stepped round bar-like lower plunger 29*b*, and a coil spring 29*c*. Then, the upper plunger 29*a* is made to contact with a spherical terminal (not shown) of the IC package 13, and the lower plunger 29*b* is made to contact with a wiring substrate (not shown), and further, these upper plunger 29*a* and lower plunger 29*b* are biased in mutually separating directions by the coil spring 29*c*, thereby electrically connecting the IC package 13 to the wiring substrate.

On the other hand, the cover member 12 includes, as shown in FIGS. 1, 4, 5 and 6A to 6C, a frame-like cover body 41 that is placed on the base part 21 of the socket body 11 and includes an opening in a middle portion in the up and down directions. On both left and ride side surfaces of the cover body 41, there are provided latch attaching dents 41*a* for fitting thereto top end portions 45*a* of the latches 45 (described later), and on both sides of the latch attaching dent 41*a*, there are provided shaft holes 41*b* for inserting therein a latch shaft 45*b* of the latch 45. Further, the cover body 41 is provided with screw holes 41*e* for inserting therein screws 41*c* for holding an elevating part 43 (described later) via springs 41*d*. Additionally, on end portions of these latch attaching dents 41*a*, there are provided vertically elongated holes 41*i* (see FIGS. 6A to 6C) for inserting therein latch locking parts 43*b* (described later). In addition, on an upper surface side in the vicinity of both front and back side surfaces of the cover body 41, there are provided pressing part insertion holes 41*f* for inserting therein a pressing part 46 (described later), and camshaft holes 41*g* for rotatably supporting this pressing part 46 with camshafts 46*g*. Then, on a lower surface side in the vicinity of both front and back side surfaces of the cover body 41, there are provided guide pins 41*h* for positioning for setting the cover member 12 to the socket body 11.

Figure 4:
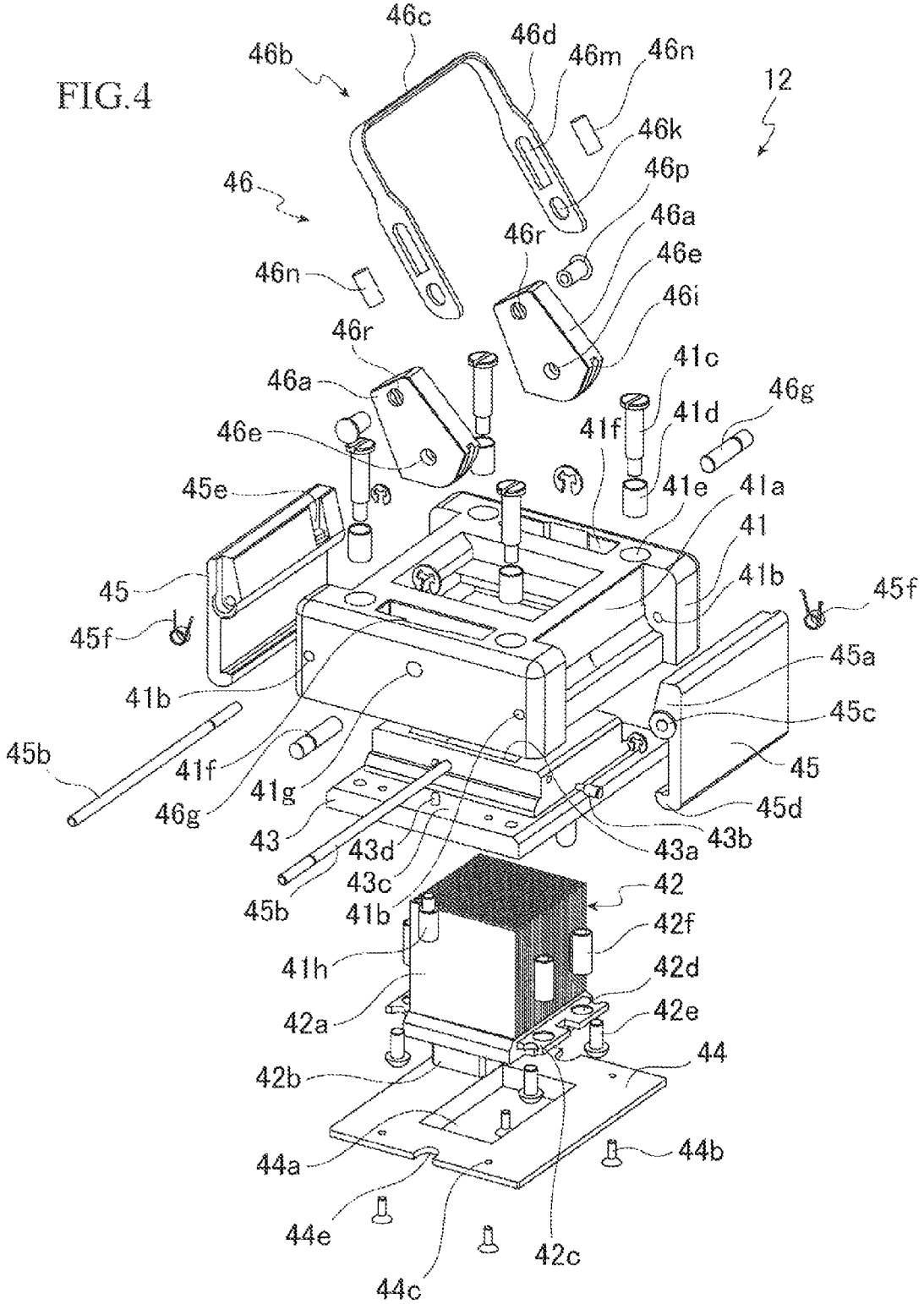
FIG. 4 is an exploded perspective view showing the configuration of a cover member of the socket for electrical component in accordance with the embodiment 1.
Figure 5:
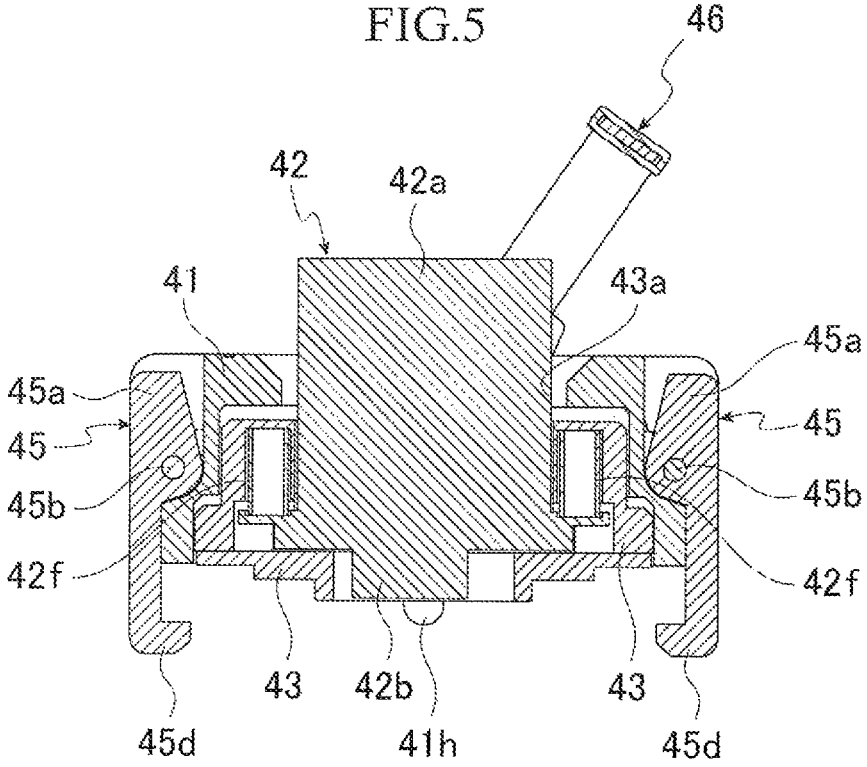
FIG. 5 is a cross-sectional view showing the configuration of the cover member of the socket for electrical component in accordance with the embodiment 1.

Additionally, the cover member 12 includes, as shown in FIG. 4, a heatsink 42 for fixing and performing heat dissipation for the IC package 13, the elevating part 43 for moving up and down the heatsink 42, and a back plate 44 for attaching the heatsink 42 to the elevating part 43.

On both left and right side surfaces of the heatsink 42, there are provided flange parts 42*c* extending toward an outer circumference direction, and each of the left and right flange parts 42*c* is provided with two recesses 42*d*. Springs 42*f* are fit into the recesses 42*d*. Additionally, screws 42*e* are screwed into screw holes (not shown) of the elevating part 43 via notches of the flange parts 42*c*, so as to fasten and fix the heatsink 42 to the elevating part 43.

The elevating part 43 is, as shown in FIG. 4, formed into a frame-like shape provided with an opening 43*a* in a middle portion in the up and down directions, and an upper portion 42*a* of the heatsink 42 is fit into this opening 43*a*. In addition, on both left and right side surfaces of the elevating part 43, there are provided the latch locking parts 43*b* (described later) by using, for example, a screw etc. Further, on a pressed surface 43*c* of the elevating part 43, there is provided cam locking parts 43*d* protruding therefrom for preventing the rotation of the pressing part 46 (described later) in the opposite direction.

Additionally, as shown in FIG. 4, the back plate 44 is also provided with an opening 44*a* in a middle portion in the up and down directions, and a lower portion 42*b* of the heatsink 42 is fit into this opening 44*a*. Further, the back plate 44 is provided with insertion holes 44*c* for inserting therein screws 44*b*, and notches 44*e* for positioning the back plate 44 by using the guide pins 41*h*.

Then, in a state where the lower portion 42*b* of the heatsink 42 is fit into the back plate 44, positioning is performed with the guide pins 41*h*, and fastening and fixing to a bottom surface of the elevating part 43 is performed by inserting the screws 44*b* into the insertion holes 44*c* from the down direction.

As shown in FIG. 4, the top end portions 45*a* of the latches 45 are fit into the latch attaching dents 41*a* of the cover body 41. A shaft hole 45*c* for inserting therein the latch shaft 45*b* is formed in the top end portion 45*a* of the latch 45, such that the shaft hole 45*c* penetrates therethrough in the front-back direction. Then, by inserting the latch shaft 45*b* into the shaft hole 45*c* of the latch 45 and shaft holes 41*b* of the cover body 41, the latch 45 is rotatably supported by the cover body 41. Additionally, a latch spring 45*f* for biasing the latch 45 in a closing direction is attached to each of the latch attaching dents 41*a*.

Here, when the latches 45 are rotated in the closing direction, it is possible to fix the cover member 12 to the socket body 11 by engaging the engaging claws 45*d* provided to the bottom end portions of the latches 45 with the engaging concave portions 21*a* (see FIG. 2) of the socket body 11. On the other hand, when the latches 45 are rotated in an opening direction, it is possible to remove the cover member 12 from the socket body 11 by releasing the engagement between the engaging claws 45*d* and the engaging concave portions 21*a*.

Figure 6A:
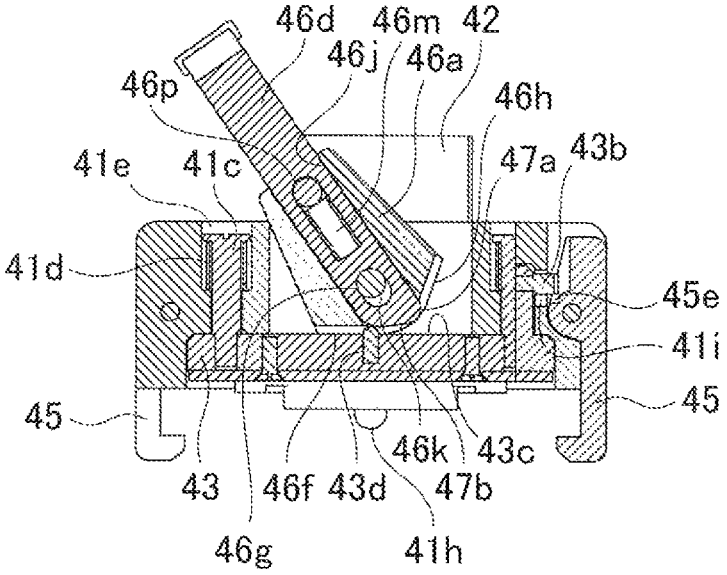
FIG. 6A is a cross-sectional view showing the configurations of an elevating mechanism and a latch mechanism of the socket for electrical component in accordance with the embodiment 1.

In addition, as shown in FIGS. 4 and 6A, the top end portions 45*a* of the latches 45 are provided with locking concave portions 45*e* as "locked portions" to be engaged with the latch locking parts 43*b* of the elevating part 43. As described later, when the elevating part 43 is moved down with the latches 45 closed, the latch locking parts 43*b* move down within the elongated holes 41*i* of the cover body 41 to be engaged with the locking concave portions 45*e*. Consequently, the rotation in the opening direction of the latches 45 is regulated, and locking is made in the closed state.

The above-described cover member 12, the pair of latches 45, the latch locking parts 43*b* and the locking concave portions 45*e* constitute a "latch mechanism" of the present invention.

Additionally, as shown in FIG. 4, the pressing part 46 is attached to the cover body 41. As described later, by rotating this pressing part 46, it is possible to press and move down the elevating part 43 to be pressed against an upper surface of the IC package 13.

The pressing part 46 includes a pair of first cams 46*a* and a bail 46*b*. The bail 46*b* includes a horizontal bar portion 46*c*, and a pair of second cams 46*d* that are bent at right angle and extend in a rotation radial direction from both ends of the horizontal bar portion 46*c*.

The first cams 46*a* are, as shown in FIG. 6A, provided with insertion slits 46*j* for inserting therein the bail 46*b* from the top end side. In addition, these first cams 46*a* are provided with shaft holes 46*e* and rivet holes 46*r* arranged along the rotation radial direction. Additionally, the bottom end portions of these first cams 46*a* are provided with, as shown in FIG. 6A, first cam surfaces 46*f* to be abut against the pressed surface 43*c* of the elevating part 43 in a state where the elevating part 43 is moved up, and second cam surfaces 46*h* to be abut against the elevating part 43 in a state where the elevating part 43 is moved down. Further, the first cam surfaces 46*f* and the second cam surfaces 46*h* of these first cams 46*a* are provided with, as shown in FIG. 4, grooves 46*i* along a rotation direction. When the first cams 46*a* are rotated, the cam locking parts 43*d* of the elevating part 43 pass through the inside of the grooves 46*i*.

The second cams 46*d* of the bail 46*b* include short elongated holes 46*k* and long elongated holes 46*m* arranged along the rotation radial direction. As shown in FIG. 6A, in the tips of the second cams 46*d*, lock portions 47*a* having a steep angle and gentle-angled portions 47*b* having a gentle angle are continuously formed via curved surfaces. In this manner, when the tips of the second cams 46*d* abut against the elevating part 43 to move down the elevating part 43, the tips of the second cams 46*d* are not locked by the cam locking parts 43*d*, and the gentle-angled portions 47*b* move on the pressed surface 43*c*. However, when an attempt is made to rotate the tips of the second cams 46*d* in the opposite direction, the lock portions 47*a* are locked by the cam locking parts 43*d*, and thus it is possible to prevent the rotation.

When assembling the pressing part 46, first, bail springs 46*n* are fit into the long elongated holes 46*m*. On this occasion, the bail springs 46*n* are fit so as to abut against tip-side end portions of the long elongated holes 46*m*. Then, after inserting the second cams 46*d* into the insertion slits 46*j* of the first cams 46*a*, rivets 46*p* are inserted into the rivet holes 46*r* of the first cams 46*a* and the long elongated holes 46*m* of the second cams 46*d*. In this manner, the first cams 46*a* are mounted to the bail 46*b*.

Next, the first cams 46*a* are inserted into the pressing part insertion holes 41*f* of the cover body 41, the camshafts 46*g* are put in from the camshaft holes 41*g* on both front and back side surfaces of this cover body 41 to be inserted into the shaft holes 46*e* of the first cams 46*a* and the short elongated holes 46*k* of the second cams 46*d*. In this manner, the first cams 46*a* and the second cams 46*d* are rotatably supported by the cover body 41, and it is possible to pull the second cams 46*d* in the rotation radial direction against the biasing force of the bail springs 46*n*.

Subsequently, a description is given of a usage method of the IC socket 10 in accordance with this embodiment 1.

Figure 7A:
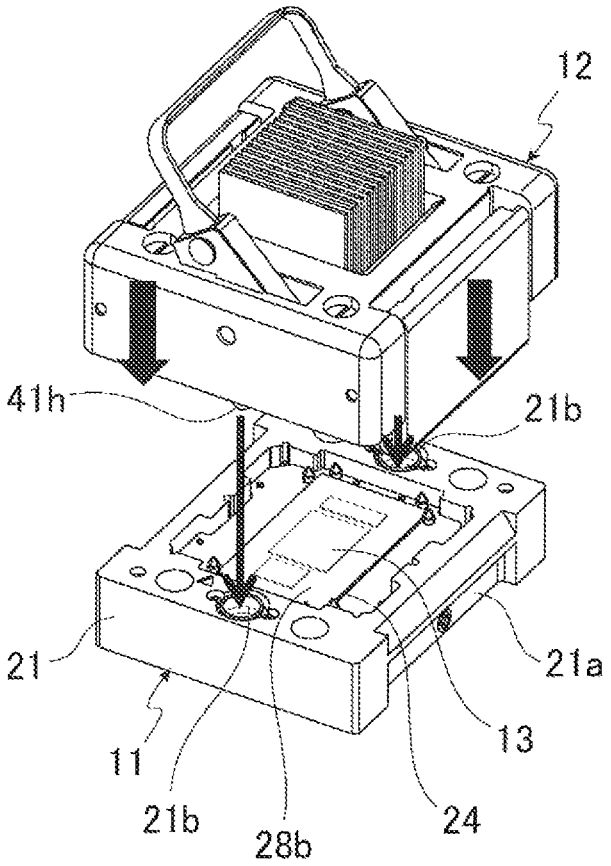
FIG. 7A is a perspective view for explaining a usage method of the socket for electrical component in accordance with the embodiment 1.

First, as shown in FIG. 7A etc., the IC package 13 is housed in the housing portion 28*b* provided in the contact module 24 of the socket body 11.

Then, the cover member 12 is installed on this socket body 11. On this occasion, by inserting the guide pins 41*h* of the cover member into the bushings 21*b* of the base part 21, the socket body 11 is positioned with the cover member 12.

Figure 7B:
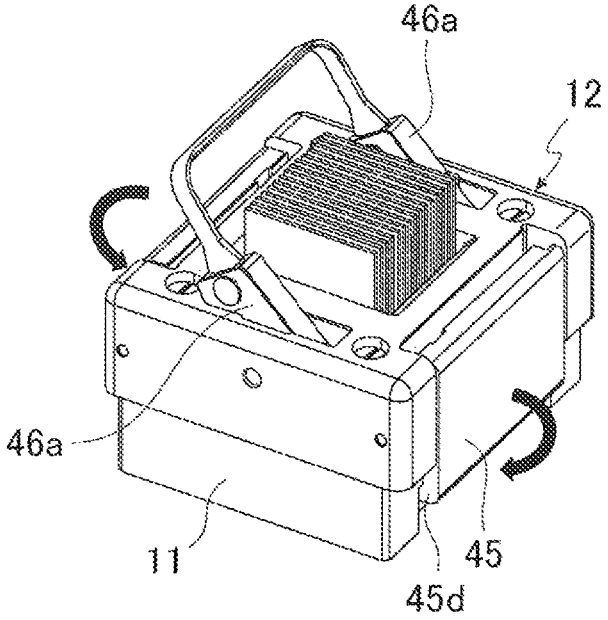
FIG. 7B is a perspective view for explaining the usage method of the socket for electrical component in accordance with the embodiment 1.

Further, as shown in FIG. 7B, the engaging claws 45*d* of the latches 45 provided to the cover member 12 are engaged with the engaging concave portions 21*a* (see FIG. 7A etc.) provided to the base part 21 of the socket body 11. On this occasion, the first cams 46*a* of the pressing part 46 abut against the pressed surface 43*c* of the elevating part 43 at the first cam surface 46*f* (see FIG. 6A). Additionally, on this occasion, as shown in FIG. 6A, the elevating part 43 is at the highest position due to the biasing force of the springs 41*d*. Thus, a bottom surface of the heatsink 42 is not pressed against the upper surface of the IC package 13.

Figure 6B:
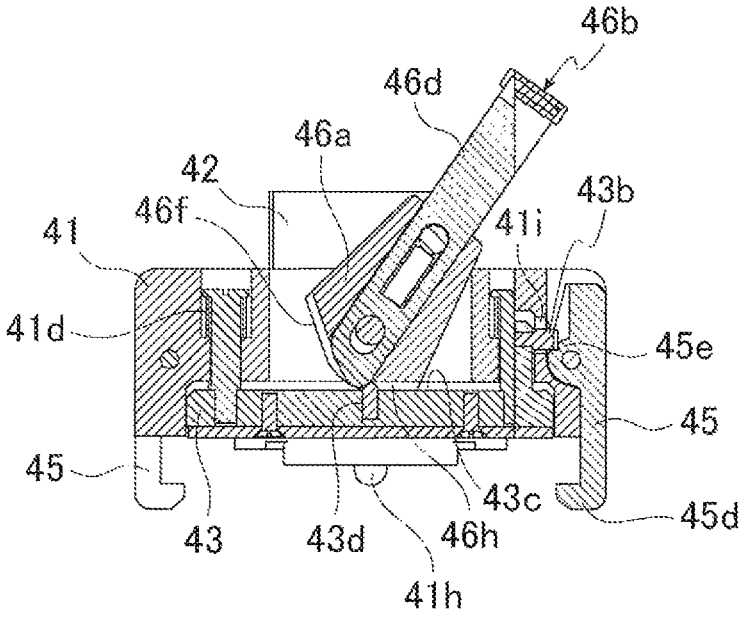
FIG. 6B is a cross-sectional view showing the configurations of the elevating mechanism and the latch mechanism of the socket for electrical component in accordance with the embodiment 1.
Figure 6C:
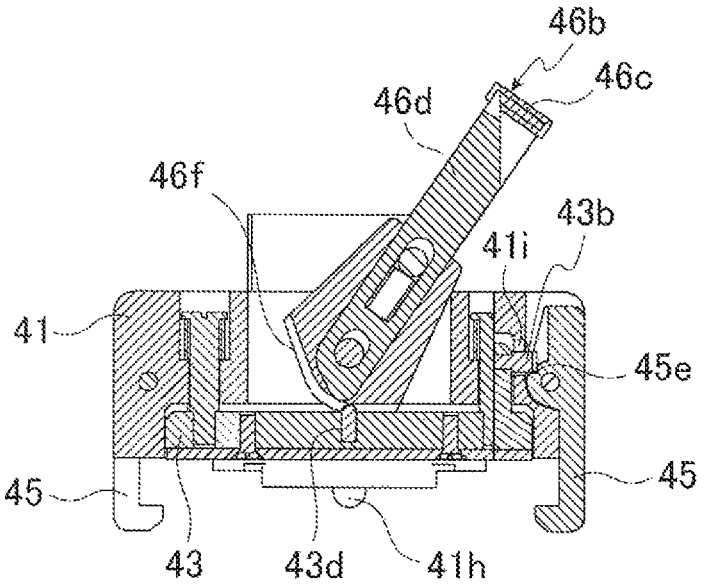
FIG. 6C is a cross-sectional view showing the configurations of the elevating mechanism and the latch mechanism of the socket for electrical component in accordance with the embodiment 1.
Figure 7C:
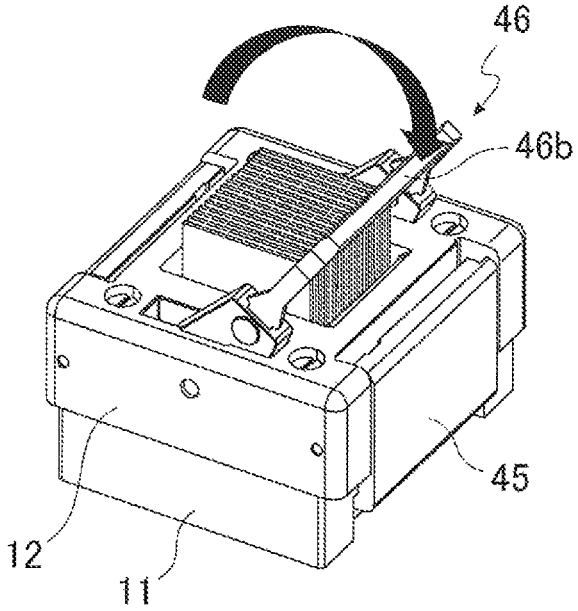
FIG. 7C is a perspective view for explaining the usage method of the socket for electrical component in accordance with the embodiment 1.

Thereafter, as shown in FIG. 7C, the bail 46*b* of the pressing part 46 is rotated from the left side to the right side in FIG. 7C. As described above, the shapes of the tips of the second cams 46*d* are formed such that the tips of the second cams 46*d* move on the pressed surface 43*c* without being locked by the cam locking parts 43*d*. Therefore, as shown in FIG. 6B, the second cams 46*d* can be rotated in accordance with the rotation of the bail 46*b*. In this manner, the first cams 46*a* are rotated in accordance with the rotation of the second cams 46*d*, and press the pressed surface 43*c* of the elevating part 43 in the down direction. Consequently, the elevating part 43 is moved down against the biasing force of the springs 41*d*, and the bottom surface of the heatsink 42 is pressed against the upper surface of the IC package 13. In this manner, the IC package 13 is fixed to the housing portion 28*b*. As described above, in this embodiment, the elevating part 43 is biased upwardly by the springs 41*d* provided in the cover body 41 (see FIG. 4, FIGS. 6A to 6C), and further, the heatsink 42 is biased downwardly by the springs 42*f* provided in the elevating part 43 (see FIG. 4, FIG. 5). Thus, it is possible to appropriately set the pressing force of the heatsink 42 with respect to the IC package 13.

Then, when the bail 46*b* is rotated to a predetermined position, the second cams 46*d* climb over the cam locking parts 43*d*, and the second cam surfaces 46*h* of the first cams 46*a* abut against the pressed surface 43*c* of the elevating part 43.

Additionally, on this occasion, since the elevating part 43 is moved down, the latch locking parts 43*b* descend within the elongated holes 41*i* of the cover body 41 to be engaged with the locking concave portions 45*e* of the latches 45. In this manner, the latches 45 are prevented from being rotated in the opening direction, and consequently, the cover member 12 cannot be removed from the socket body 11.

As described above, the shapes of the tips of the second cams 46*d* are formed such that the tips of the second cams 46*d* are engaged with the cam locking parts 43*d*, and the rotation in the opposite direction cannot be made. Thus, once the second cams 46*d* climb over the cam locking parts 43*d*, the first cams 46*a* also cannot be rotated in the opposite direction. Thus, IC socket 10 is locked in a state where the heatsink 42 is pressed against the IC package 13, and the engaging claws 45*d* of the latches 45 are engaged with the engaging concave portions 21*a* of the socket body 11.

On the other hand, when unlocking this lock, first, as shown in FIG. 6C, the horizontal bar portion 46*c* of the bail 46*b* is pulled up in a direction away from the elevating part 43. In this manner, because the tips of the second cams 46*d* are moved to be above the cam locking parts 43*d*, it is possible to rotate the second cams 46*d* in the opposite direction, that is, the left direction in FIG. 6C. Then, when the bail 46*b* is rotated in the opposite direction, and the tips of the second cams 46*d* climb over the cam locking parts 43*d*, the elevating part 43 is moved up to the highest position due to the biasing force of the springs 41*d*. In this manner, the heatsink 42 is moved up and separated from the IC package 13, and the engagement between the locking concave portions 45*e* of the latches 45 and the latch locking parts 43*b* of the elevating part 43 is released. Consequently, it is possible to remove the cover member 12 from the socket body 11 by releasing the engagement between the engaging claws 45*d* and the engaging concave portions 21*a* of the socket body 11.

As explained above, according to this embodiment 1, the latch locking parts 43*b* are provided to the elevating part 43, and are engaged with the latches 45 when the elevating part 43 is moved down, so as to prevent the rotation of the latches 45. Thus, it is possible to securely lock the latches 45 only with a simple operation.

Additionally, according to this embodiment 1, the latch locking parts 43*b* of the elevating part 43 project in the horizontal direction, and the locking concave portions 45*e* to be locked by the latch locking parts 43*b* are provided in the vicinity of the shaft holes 45*c* of the latches 45. Thus, it is possible to securely lock the latches 45 with a simple configuration.

REFERENCE SIGNS LIST

10 IC socket
11 socket body
12 cover member
13 IC package
21 base part
21*a* engaging concave portion
22 bottom plate
23 insulating plate
24 contact module
41 cover body
42 heatsink
43 elevating part
43*b* latch locking part
43*d* cam locking part
44 back plate
45 latch
45*e* locking concave portion
46 pressing part
46*a* first cam
46*b* bail
46*c* horizontal bar portion
46*d* second cam
46*k* short elongated hole
46*m* long elongated hole
46*n* bail spring

The invention claimed is:

1. A latch mechanism comprising:

a cover member including a cover body covering an upper side opening surface of a housing body, an elevating part supported by the cover body such that the elevating part can be moved up and down, and a pressing part supported by the cover body and moving down the elevating part;

a pair of latch parts whose top end portions are rotatably supported on outside surfaces of the cover body, and whose bottom end portions are engaged with the housing body, so as to fix the cover body to the housing body; and latch locking parts provided to the elevating part, and engaged with the latch parts when moved down, so as to prevent rotation of the latch parts in a direction in which engagement between the latch parts and the housing body is released.

2. The latch mechanism according to claim 1, wherein the top end portions of the latch parts are provided with shaft holes for inserting therein rotation shafts provided to the cover body, the bottom end portions of the latch parts are provided with locking claws to be locked to the housing body, the latch locking parts of the elevating part project in a horizontal direction, and locked portions, which are locked by the latch locking parts when the elevating part is moved down, are provided in the vicinity of the shaft holes of the latch parts.

3. A socket for electrical component, including: a socket body as the housing body in which an electrical component is housed in a housing portion provided in an upper surface side, and a contact pin to be electrically connected to the electrical component is provided; and the cover member removably provided to the socket body and covering the housing portion of the socket body, the socket for electrical component comprising:

the latch mechanism according to claim 1.

* * * * *